United States Patent [19]

Kawamura et al.

[11] Patent Number: 4,684,341

[45] Date of Patent: Aug. 4, 1987

[54] FUEL VAPORIZATION APPARATUS FOR COMBUSTOR

[75] Inventors: Hideo Kawamura; Yukio Yoshida; Keiichi Yamashita, all of Fujisawa, Japan

[73] Assignee: Isuzu Motors, Ltd., Tokyo, Japan

[21] Appl. No.: 877,492

[22] Filed: Jun. 23, 1986

[51] Int. Cl.[4] ..... F23D 11/44

[52] U.S. Cl. ..... 431/242; 431/208; 123/179 H; 123/549; 123/551

[58] Field of Search ..... 431/208, 242, 161; 123/179 H, 549, 550, 551

[56] References Cited

U.S. PATENT DOCUMENTS 3,653,794 4/1972 Shakiba ..... 431/208

*Primary Examiner*—Carroll B. Dority, Jr.

*Attorney, Agent, or Firm*—John E. Toupal; Harold G. Jarcho

[57] ABSTRACT

A liquid fuel combustion apparatus including a housing defining a composite chamber; a perforate wall separating the composite chamber into a vaporization chamber and a combustion chamber and distributing the flow of vapor therebetween; an intake pipe providing air flow to the vaporization and combustion chambers; and a vaporization pipe comprising an inlet portion disposed in the combustion chamber and a discharge portion projecting into the vaporization chamber, the discharge portion defining a jet for discharging fuel into the vaporization chamber. Also included is a means for feeding liquid fuel into an end of the vaporization pipe opposite to the discharge portion, and an igniter for igniting fuel in the combustion chamber.

18 Claims, 4 Drawing Figures

FUEL VAPORIZATION APPARATUS FOR COMBUSTOR

BACKGROUND OF THE INVENTION

The present invention relates generally to liquid fuel combustion apparatus and, more particularly, to such apparatus for warming internal combustion engines for vehicles.

Japanese patent application No. 213156/84 discloses a warming apparatus in which a combustor and a heat exchanger are disposed at an intake pipe of an engine. Combustion gas produced in the combustor is mixed with intake air and the mixture is fed to the engine. According to this warming apparatus, the intake temperature is increased to enhance engine start-up, shorten engine warm-up and provide more rapid heating of vehicle compartments with the heat exchanger.

However, the fuel vaporization apparatus of the above-described combustor is not sufficiently efficient and unvaporizaed fuel is sometimes jetted into a vaporization chamber. To avoid this problem, an electrical heater is provided to heat and vaporize fuel within the vaporization apparatus. However, the continuously energized heater consumes significant electric power and can cause discharge of the normal power supply batteries carried by the vehicle.

The object of the present invention, therefore, is to provide fuel vaporization apparatus which is capable of completely vaporizing fuel supplied to a combustion chamber for enhancing warm-up of an engine.

SUMMARY OF THE INVENTION

The invention is a liquid fuel combustion apparatus including a housing defining a composite chamber; a perforate wall separating the composite chamber into a vaporization chamber and a combustion chamber and distributing the flow of vapor therebetween; an intake pipe providing air flow to the vaporization and combustion chambers; and a vaporization pipe comprising an inlet portion disposed in the combustion chamber and a discharge portion projecting into the vaporization chamber, the discharge portion defining a jet for discharging fuel into the vaporization chamber. Also included is a means for feeding liquid fuel into an end of the vaporization pipe opposite to the discharge portion, and an igniter for igniting fuel in the combustion chamber. The vaporization pipe is heated by combustion gases in the combustion chamber so as to function effectively as a fuel vaporizer.

According to certain features of the invention, the discharge portion of the vaporization pipe extends through and is supported by a central portion of the perforate wall, and heat exchange fins project outwardly from the vaporization pipe and are formed integrally therewith. This arrangement enhances the transfer of heat between the combustion gases and the vaporization pipe.

According to other features of the invention the discharge portion of the vaporization pipe has an outer diameter and a wall thickness less than those of the inlet portion. These features further enhance the fuel vaporization process in the vaporization pipe.

According to still another feature, the invention includes a heater disposed in the vaporization pipe for heating fuel flowing therethrough. The heater insures vaporization of fuel prior to the availability of hot gases in the combustion chamber.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
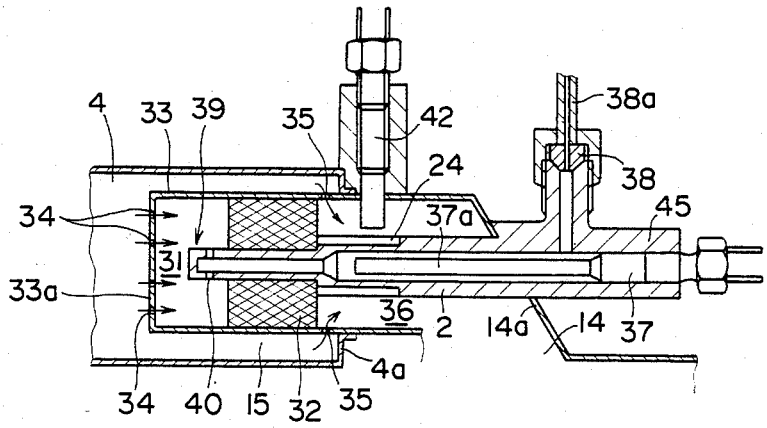
FIG. 1 is a schematic sectional view of a combustor and fuel vaporization apparatus in accordance with a first embodiment of the invention.
Figure 2:
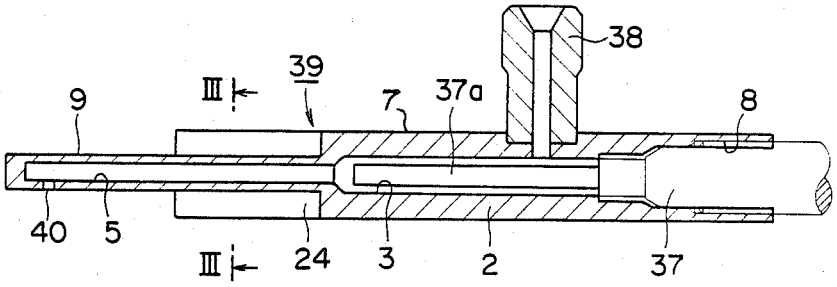
FIG. 2 is a schematic sectional view of the fuel vaporization apparatus shown in FIG. 1.
Figure 3:
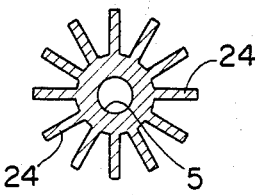
FIG. 3 is a schematic sectional view taken along lines III—III of FIG. 2.

Illustrated in FIGS. 1-3 is a first embodiment including an intake pipe 4 connected to an air cleaner (not shown) and an intake pipe 14 connected to an intake manifold (not shown). Fitted in and supported by an end wall 4*a* of the intake pipe 4 is a combustion housing cylinder 33 that defines a composite chamber arranged coaxial therewith. The composite chamber is separated into a combustion chamber 36 and a vaporization chamber 31 by a perforate, flow distributing wall plate 32. Preferably, the wall plate 32 is formed from a ceramic honey-comb. A portion of the pipe 14 connected to the intake manifold is preferably formed in a crank configuration portion 14*a* and a mounting member 45 extends through the portion 14*a* and is supported thereby. Retained by the mounting member 45 is a fuel vaporization device 39 including a vaporization pipe 2. An inlet portion 7 of the pipe is centrally disposed in the combustion chamber 36 and encloses a heat generating rod portion 37*a* of a heating plug 37. Receiving the heating plug 37 is a tapped hole 8 in the vaporization pipe 2. A discharge portion 9 of the pipe extends through and is supported by a central portion of the perforate wall 32. Defined by the discharge portion 9 are jets 40 opening into the vaporization chamber 39.

Formed in an end wall 33*a* of the combustion cylinder 33 are intake ports 34 that provide communication between the intake pipe 4 and the vaporization chamber 39. In addition, an air preheating chamber 15 is formed between the outer wall of the combustion cylinder 33 and an inner wall of the intake pipe 4. Intake ports 35 in the circumferential wall of the combustion cylinder 33 provide communication between the air preheating chamber 15 and the combustion chamber 36. A firing plug 42 is mounted adjacent to a connection between the intake pipe 14 and the intake pipe 4, and a heat generating portion thereof projects into the combustion chamber 36.

As shown in FIG. 2, the discharge portion 9 of the fuel vaporization pipe 2, preferably formed of ceramics or heat-resistant metal, has a smaller outer diameter than does the inlet portion 7 retained in the combustion chamber 36. In addition, the wall thickness of the discharge portion 9 is less than that of the inlet portion 7. A clearance is provided between a passage 3 in the inlet portion of the pipe 2 and and the heat generating portion 37*a* of the electrical heater 37 and a fuel supply pipe 38*a* (FIG. 1) is connected to a base end of the passage 3 by a nipple 38. The passage 3 terminates near the central portion of the combustion chamber 36 and is connected to the reduced diameter passage 5 in the discharge portion 9.

According to the present invention, a heat exchanger is provided for the inlet portion 7 of the vaporization pipe 2 retained in the combustion chamber 36. The heat exchanger consists of plurality of fins 24 extending radially from the vaporization pipe 2 and formed integrally therewith. Preferably, the reduced diameter passage 5 extends into that portion of the pipe 2 that defines the fins 24, as shown in FIG. 2. As also shown, outer ends of the heat absorbing fins 24 are axially aligned with the outer diameter of the fuel vaporization pipe portion 7 that accommodates the heat generating portion 37*a* of the heating plug 37. The fins 24 abut against the flow adjusting plate 32.

OPERATION

Air in the intake pipe 4 is taken into the vaporization chamber 31 through the intake ports 34 and into the combustion chamber 36 through the intake ports 35. In addition, fuel supplied from the fuel supply pipe 38*a* into the fuel vaporization pipe 2 is heated and vaporized by the heat generating portion 37*a* of the heating plug 37. The vaporized fuel flows from the passage 3 into the passage 5 and is sprayed from the jets 40 into the vaporization chamber 31. After being mixed in the vaporization chamber 31, the vaporized fuel and air mixture flows through the wall plate 32 and is distributed thereby into the combustion chamber 36. When the mixture is heated to firing terperature by the firing plug 42, combustion occurs and combustion gases are taken from the intake pipe 14 into an intake manifold through a heat exchanger. (not shown)

Since the inlet portion 7 of the fuel vaporization pipe 2 is disposed in the combustion chamber 36 adjacent to the wall plate 32 and is provided with the integrally formed heat absorbing fins 24, an excellent heat exchange is established between the combustion chamber and the fuel in the passage 5. Therefore, when fuel is once fired, the fuel in the passage 5 is heated and vaporized and the heater 37 can be de-energized.

The heat absorbing fins 24 extend axially of the fuel vaporization pipe 2 and in the flow of the mixture passing through the flow distributing wall plate 32. Therefore, the heat absorbing fins 24 are effectively heated by flame in the combustion chamber 36. The passage 3 is larger in diameter than is the passage 5, so as to provide a cavity suitable for receiving the similarly sized heat generating portion 37*a* of the heating plug 37. Conversely, the discharge end 9 of the fuel vaporization chamber 2 is smaller in both outer diameter and wall-thickness. Consequently, the thermal capacity of the discharge end 9 is reduced to minimize heat emission and maintain the fuel flowing through the passage 5 in a vaporized condition. Particularly because the passage 5 is smaller in inside diameter than is the passage 3 that accommodates the heating plug 37 and has a reduced wall thickness, fuel is vaporized immediately by heat received from the heat absorbing fins 24. Since the thermal capacity of the wall portion surrounding the passage 5 is small, the heat loss from the vaporized fuel is minimized and the fuel is discharged in the vaporized or atomized state from the jets 40 into the vaporization chamber 31.

Thus, in the present invention, after combustion is started in the combustion chamber 36, complete vaporization of fuel is accomplished in the vaporization pipe without energization of the heating plug 37. The energization time required for the fuel vaporizing heating plug 37 and the firing plug 42 therefore is shortened resulting in longer component life, power conservation, and reduced drain on the vehicle's power supply batteries.

Figure 4:
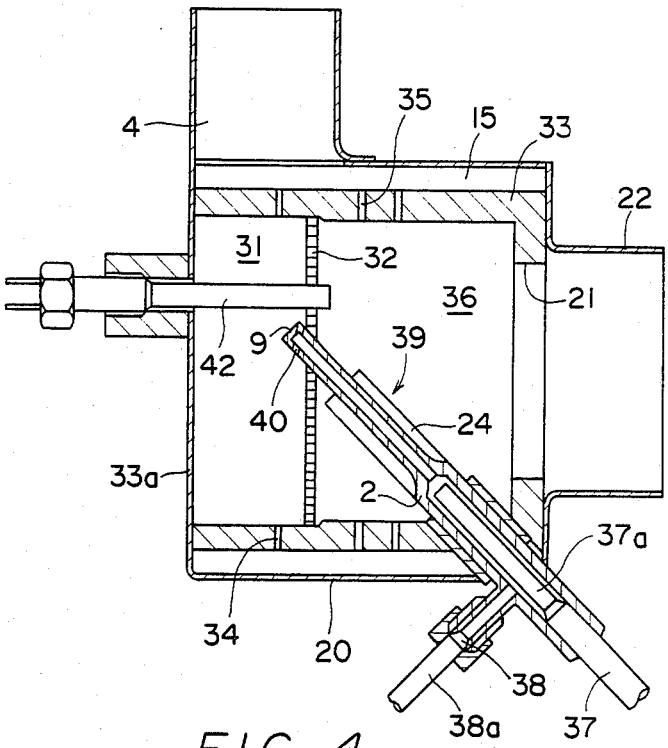
FIG. 4 is a schematic sectional view showing another embodiment of the invention.

In the embodiment shown in FIG. 4, there is provided a housing 20 that defines an air preheating chamber 15 externally of a combustion cylinder 33. An end wall 33*a* closes one end of both the combustion cylinder 33 and the preheating chamber 15. Connected to the circumferential wall of the housing 20 is an intake pipe 4 whereas an exhaust pipe 22 is connected to an opposite end wall thereof. An opening 21 in the end wall of the combustion cylinder 33 is brought into communication with an intake manifold (not shown) by the exhaust pipe 22. Supported on the end wall 33*a* is a firing plug 42 that extends through a flow distributing wall plate 32 and a vaporization chamber 31 into a combustion chamber 36. A fuel vaporization device 39 extends through and is supported by the housing 20 and the circumferential wall of the combustion cylinder 33. Included in the device 39 is a fuel vaporization pipe 2 that extends through a central portion of the wall plate 32 and defines jets 40 adjacent to the firing plug 42 in the vaporization chamber 31. Other structures of the embodiment illustrated in FIG. 4 are similar to those of the embodiment shown in FIG. 1 and bear the same reference numerals. Also, this embodiment operates in the same manner as does the FIG. 1 embodiment.

Obviously, many modifications and variations of the present invention are possible in light of the above teachings. It is to be understood, therefore, that the invention can be practiced otherwise than as specifically described.

What is claimed:

1. Liquid fuel combustion apparatus comprising:

housing means defining a composite chamber;

a perforate wall separating said composite chamber into a vaporization chamber and a combustion chamber and distributing the flow of vapor therebetween;

intake pipe means providing air flow to said vaporization and combustion chambers;

a vaporization pipe comprising an inlet portion disposed in said combustion chamber and a discharge portion projecting into said vaporization chamber, said discharge portion defining a jet for discharging fuel into said vaporization chamber;

fuel supply means for feeding liquid fuel into said inlet portion of said vaporization pipe; and igniter means disposed in said combustion chamber and for igniting fuel therein.

2. Combustion apparatus according to claim 1 including heat exchange means disposed in said combustion chamber and in heat exchanging contact with said vaporization pipe.

3. Combustion apparatus according to claim 2 wherein said discharge portion of said vaporization pipe extends through and is supported by said perforate wall.

4. Combustion apparatus according to claim 3 wherein said heat exchange means comprises fins projecting outwardly from a heat exchange portion of said vaporization pipe and formed integrally therewith.

5. Combustion apparatus according to claim 4 wherein said vaporization pipe extends through a central portion of said perforate wall and said fins are disposed directly adjacent thereto.

6. Combustion apparatus according to claim 5 wherein said discharge portion of said vaporization pipe defines a reduced diameter fuel flow passage with a diameter less than that of a fuel flow passage defined by said inlet portion.

7. Combustion apparatus according to claim 6 wherein said discharge portion of said vaporization pipe has a wall thickness less than that of said inlet portion.

8. Combustion apparatus according to claim 6 wherein said vaporization pipe is formed from ceramic.

9. Combustion apparatus according to claim 7 wherein said reduced diameter fuel flow passage extends into said heat exchange portion of said vaporization pipe.

10. Combustion apparatus according to claim 9 wherein said housing means defines intake ports providing communication between said intake pipe means and said vaporization chamber, and intake ports providing communication between said combustion chamber and said intake pipe means.

11. Combustion apparatus according to claim 1 including a heater disposed in said vaporization pipe and for heating fuel flowing therethrough.

12. Combustion apparatus according to claim 11 including heat exchange means disposed in said combustion chamber and in heat exchanging contact with said vaporization pipe.

13. Combustion apparatus according to claim 12 wherein said discharge portion of said vaporization pipe extends through and is supported by said perforate wall.

14. Combustion apparatus according to claim 13 wherein said heat exchange means comprises fins projecting outwardly from said vaporization pipe and formed integrally therewith.

15. Combustion apparatus according to claim 14 wherein said vaporization pipe extends through a central portion of said perforate wall and said fins are disposed directly adjacent thereto.

16. Combustion apparatus according to claim 15 wherein said discharge portion of said vaporization pipe has an outer diameter less than that of said inlet portion.

17. Combustion apparatus according to claim 1 wherein said discharge portion of said vaporization pipe has an outer diameter less than that of said inlet portion.

18. Combustion apparatus according to claim 17 wherein said discharge portion of said vaporization pipe has a wall thickness less than that of said inlet portion.

* * * * *